US010396519B2

(12) United States Patent
Busies et al.

(10) Patent No.: US 10,396,519 B2
(45) Date of Patent: Aug. 27, 2019

(54) TWO-PIECE MALE ELECTRIC TERMINAL AND METHOD OF ASSEMBLING SAME

(71) Applicant: Lear Corporation, Southfield, MI (US)

(72) Inventors: Rainer Busies, Wuppertal (DE); Dirk Winter, Remscheid (DE); Sami Mezrioui, Remscheid (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/785,483

(22) Filed: Oct. 17, 2017

(65) Prior Publication Data

US 2018/0151997 A1 May 31, 2018

(30) Foreign Application Priority Data

Nov. 30, 2016 (DE) ..... 10 2016 123 162

(51) Int. Cl.

| | |
|---|---|
| ***H01R 13/10*** | (2006.01) |
| ***H01R 43/16*** | (2006.01) |
| ***H01R 4/48*** | (2006.01) |
| ***H01R 4/62*** | (2006.01) |
| ***H01R 13/04*** | (2006.01) |
| *H01R 4/18* | (2006.01) |

(Continued)

(52) U.S. Cl.

CPC ..... *H01R 43/16* (2013.01); *H01R 4/4809* (2013.01); *H01R 4/62* (2013.01); *H01R 13/04* (2013.01); *H01R 4/185* (2013.01); *H01R 13/113* (2013.01); *H01R 13/20* (2013.01)

(58) Field of Classification Search

CPC ..... H01R 43/16; H01R 13/113; H01R 13/10; H01R 4/18; H01R 4/184; H01R 4/62; H01R 4/20; H01R 13/04; H01R 4/185; H01R 13/055; H01R 13/05; H01R 13/20; H01R 12/58; H01R 24/28

USPC ..... 439/891, 866, 843

See application file for complete search history.

(56) References Cited

U.S. PATENT DOCUMENTS 3,920,310 A * 11/1975 Walsh ..... H01R 13/115 439/730

4,010,993 A * 3/1977 Hohenberger ..... H01R 13/35 439/176

(Continued)

FOREIGN PATENT DOCUMENTS

FR 2759500 A1 8/1998

*Primary Examiner* — Xuong M Chung Trans

(74) *Attorney, Agent, or Firm* — MacMillan, Sobanski & Todd, LLC

(57) ABSTRACT

A two-piece male electric terminal includes an attachment piece with an attachment fastener portion that extends along a terminal axis. The two-piece male terminal also includes a contact piece with a lance and a contact fastener portion that extends along the terminal axis. One of the attachment fastener portion and the contact fastener portion includes a box structure. The box structure is positioned around and extends along the terminal axis and defines an interior space. The box structure includes a resilient contact locator that extends from a wall of the box structure into the interior space. The other of the attachment fastener portion and the contact fastener portion is located in the interior space. The contact locator is pre-stressed against the other of the attachment fastener portion and the contact fastener portion. The two-piece male terminal also includes a weld applied between the attachment piece and the contact piece.

12 Claims, 6 Drawing Sheets

(51) Int. Cl.
*H01R 13/11* (2006.01)
*H01R 13/20* (2006.01)

(56) References Cited

U.S. PATENT DOCUMENTS

| | | | | | |
|---|---|---|---|---|---|
| 4,031,614 | A | | 6/1977 | Gipe | |
| 4,699,444 | A | * | 10/1987 | Isohata | H01R 13/113 439/839 |
| 4,838,816 | A | * | 6/1989 | Matsusaka | H01R 13/193 439/861 |
| 5,399,110 | A | * | 3/1995 | Morello | H01R 4/185 439/879 |
| 5,639,270 | A | * | 6/1997 | Barbieri | H01R 13/20 439/849 |
| 5,695,368 | A | * | 12/1997 | Joly | H01R 13/432 439/748 |
| 6,004,172 | A | | 12/1999 | Kerek | |
| 6,290,556 | B1 | | 9/2001 | Howland et al. | |
| 7,556,541 | B2 | * | 7/2009 | Tyler | H01R 13/03 439/843 |
| 7,976,353 | B2 | * | 7/2011 | Myer | H01R 13/04 439/891 |
| 2008/0287000 | A1 | | 11/2008 | Yavari et al. | |
| 2013/0171873 | A1 | | 7/2013 | Kanda et al. | |

* cited by examiner

TWO-PIECE MALE ELECTRIC TERMINAL AND METHOD OF ASSEMBLING SAME

BACKGROUND OF THE INVENTION

This invention relates in general to two-piece male electric terminals. In particular, this invention relates to an improved structure for a two-piece male electric terminal that includes features to simplify assembly thereof.

A two-piece male electric terminal is typically made of two different materials having different desired properties. This allows a first portion of the male terminal that is attached to a wire have a first set of properties and a second portion of the male terminal that contacts a corresponding female terminal to have a second set of properties. The different materials used to form the two parts of the male terminal may be selected for desired properties, such as electrical conductivity, stability when exposed to various temperatures, durability, cost, weight, and the like.

In order to produce the two-piece male electric terminal, the two pieces are made separately and are then assembled together. The two pieces are typically connected to each other by welding. It is desirable that the two pieces be positioned properly relative to each other during assembly. This can be difficult when the two pieces are physically small, such as having widths measured in millimeters or less than a millimeter. A small misalignment between the two pieces during assembly can render the assembled component defective. Thus, it would be advantageous to have an improved structure for a two-piece male electric terminal that includes features to simplify assembly thereof.

SUMMARY OF THE INVENTION

The invention relates to a two-piece male electric terminal. The two-piece male electric terminal includes an attachment piece with an attachment fastener portion that extends along a terminal axis. The two-piece male terminal also includes a contact piece with a lance and a contact fastener portion that extends along the terminal axis. One of the attachment fastener portion and the contact fastener portion includes a box structure. The box structure is positioned around and extends along the terminal axis. The box structure also defines an interior space. The box structure includes a resilient contact locator that extends from a wall of the box structure into the interior space. The other of the attachment fastener portion and the contact fastener portion is located in the interior space. The contact locator is pre-stressed against the other of the attachment fastener portion and the contact fastener portion. The two-piece male terminal also includes a weld applied between the attachment piece and the contact piece.

In another embodiment, the two-piece male terminal includes an attachment piece that includes an attachment fastener portion that extends along a terminal axis. The attachment fastener portion includes a box structure that is positioned around and extends along the terminal axis. The box structure also defines an interior space. The box structure includes a resilient contact locator that extends from a wall of the box structure into the interior space. The two-piece male terminal also includes a contact piece. The contact piece includes a lance and a contact fastener portion that extends along the terminal axis. The contact fastener portion is located in the interior space. The contact fastener portion includes a notch. The resilient contact locator is located in and is pre-stressed in the notch. A second contact locator extends from the box structure into the interior space.

The second contact locator engages the contact fastener portion. The resilient contact locator and the second contact locator are located on opposed sides of the terminal axis. The two-piece male terminal also includes a retainer applied to the attachment piece and the contact piece and adapted to retain the contact piece in an assembled position relative to the attachment piece.

This invention also relates to a method of assembling a two-piece male electric terminal. The method includes moving an attachment piece relative to a contact piece along a terminal axis in an assembly direction. An insertion end on one of the attachment piece and the contact piece is moved into an interior space of a box structure on the other of the attachment piece and the contact piece. The method also includes deflecting a resilient contact locator away from the terminal axis by a force applied by the one of the attachment piece and the contact piece. The method also includes moving the attachment piece relative to the contact piece along the terminal axis in an assembly direction to an assembled position. The method also includes applying a weld between the attachment piece and the contact piece.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
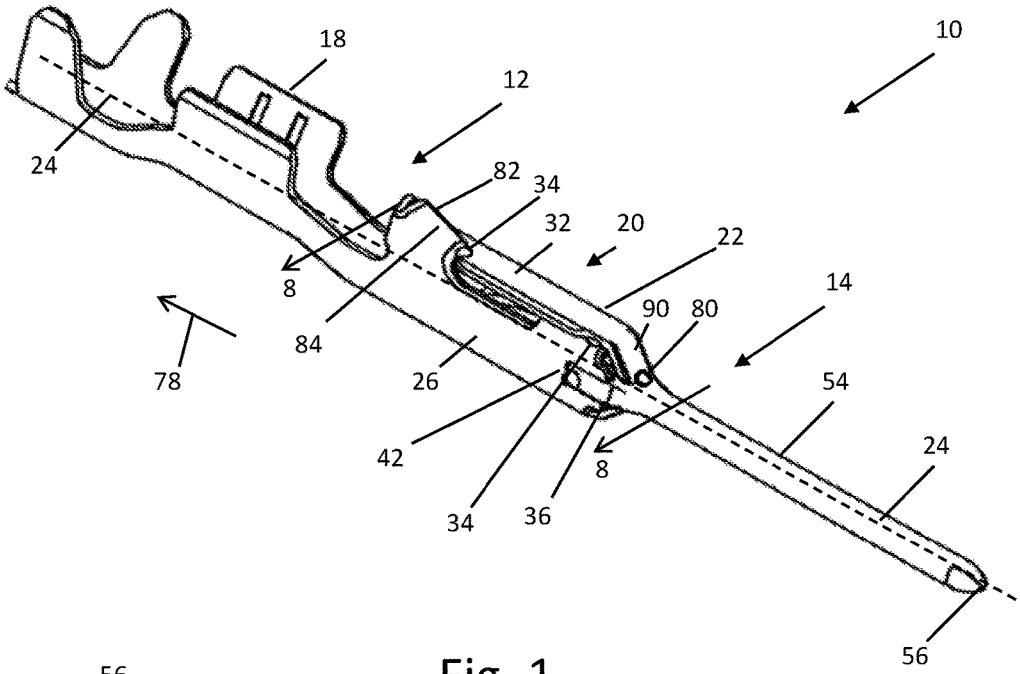
FIG. 1 is a front perspective view of a first embodiment of a two-piece male electric terminal in accordance with this invention.
Figure 2:
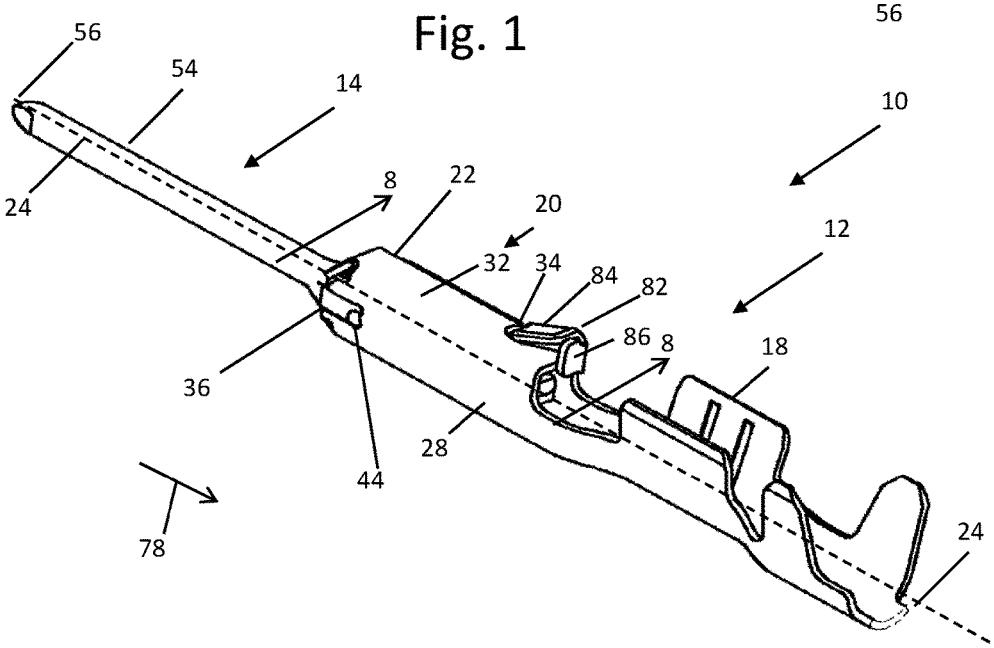
FIG. 2 is a rear perspective view of the first embodiment of the two-piece male electric terminal illustrated in FIG. 1.
Figure 8:
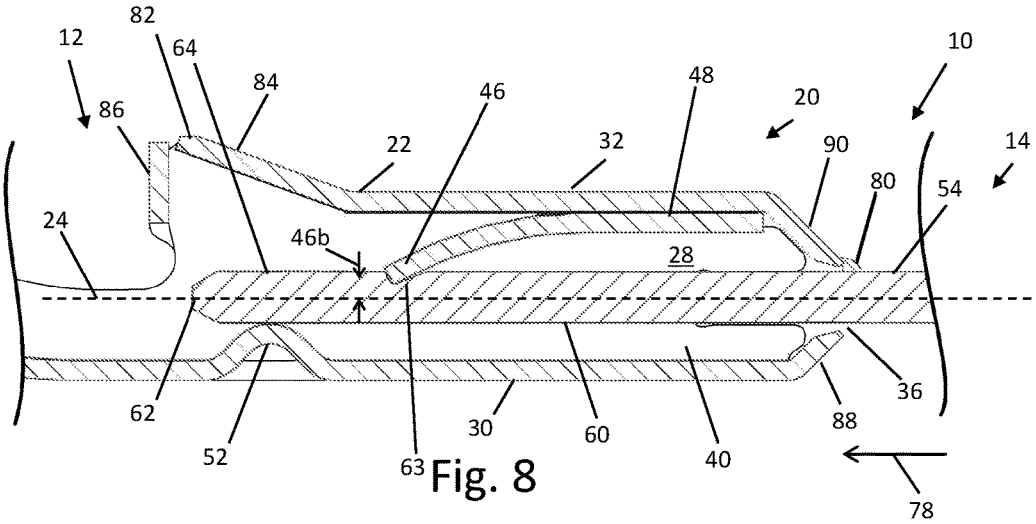
FIG. 8 is a cross-sectional view of a portion of the first embodiment of the two-piece male electric terminal taken along line 8-8 of FIG. 1.
Figure 9:
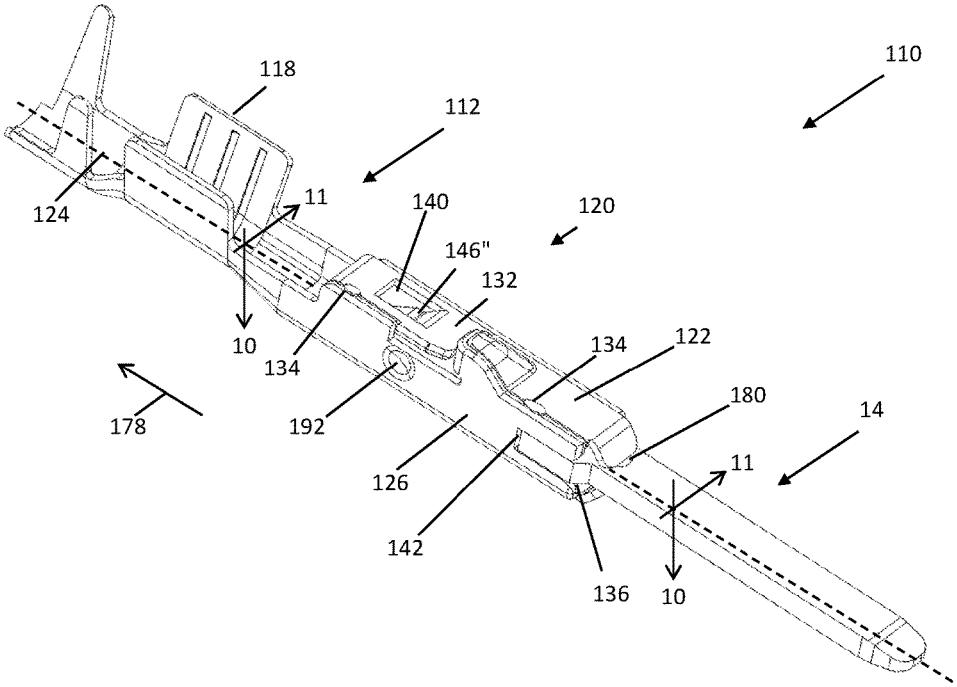
FIG. 9 is a front perspective view of a second embodiment of a two-piece male electric terminal in accordance with this invention.

Referring now to the drawings, there is illustrated in FIGS. 1, 2, and 8 a first embodiment of a two-piece male electric terminal, indicated generally at 10, in accordance with this invention. The two-piece male electric terminal 10 includes an attachment piece, indicated generally at 12 and a contact piece, indicated generally at 14. The two-piece male electric terminal 10 is adapted to mate with a corresponding female connector (not shown) in a manner that is well known in the art. The illustrated two-piece male electric terminal 10 is a 0.5 mm connector, meaning the contact piece 14 has a width of 0.5 mm. However, the contact piece 14 and the two-piece male electric terminal 10 may have any desired sizes.

Figure 3:
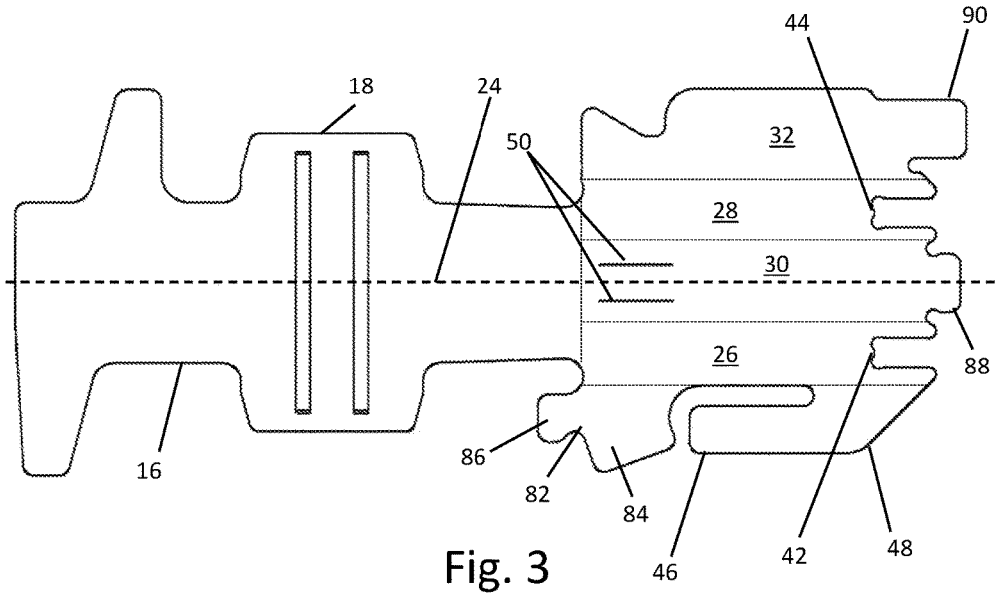
FIG. 3 is a top plan view of a stamped blank that is folded to create an attachment piece of the first embodiment of the two-piece male electric terminal.

Referring to FIG. 3, a top plan view of a stamped blank 16 that can be used to form the attachment piece 12 is shown. The stamped blank 16 is preferably cut into the illustrated shape from a piece of piece of sheet metal, then folded to create the attachment piece 12. However, the attachment piece 12 may be made by any other desired method. The illustrated attachment piece 12 is made of a copper alloy and includes a tin plating. However, the attachment piece 12 may be made of any desired material, may have no plating, or may have one or more layers of any desired plating material applied. The components of the attachment piece 12 are numbered in FIG. 3, but are better understood in reference to the assembled attachment piece 12 described below.

Figure 4:
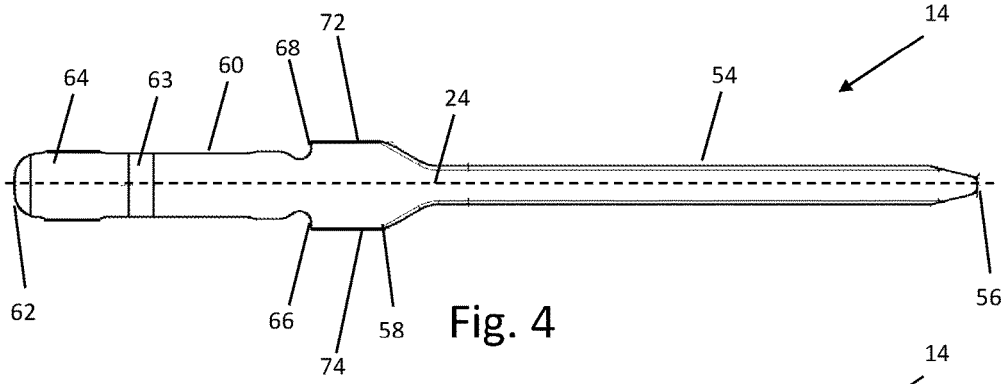
FIG. 4 is a top plan view of a contact piece of the first embodiment of the two-piece male electric terminal.
Figure 5:
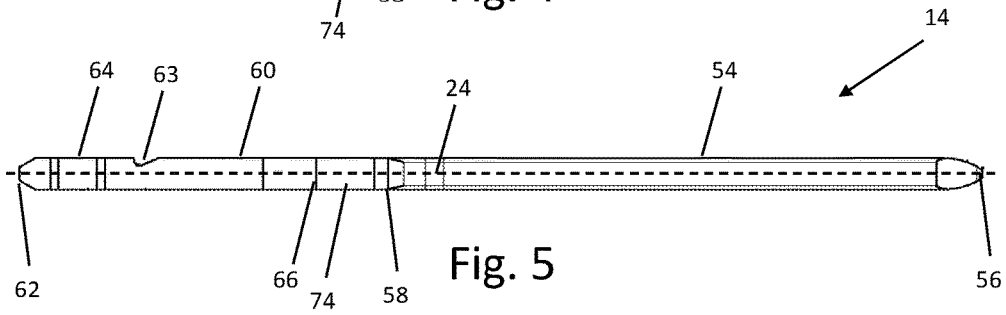
FIG. 5 is a side elevational view of the contact piece illustrated in FIG. 4.

FIGS. 4 and 5 illustrate the structure of the contact piece 14 as being stamped from a piece of sheet metal. However, the contact piece 14 may be made by any desired method. The illustrated contact piece 14 is made of a copper alloy and includes a tin plating. However, the contact piece 14 may be made of any desired material, may have no plating, or may have one or more layers of any desired plating material applied.

Figure 6:
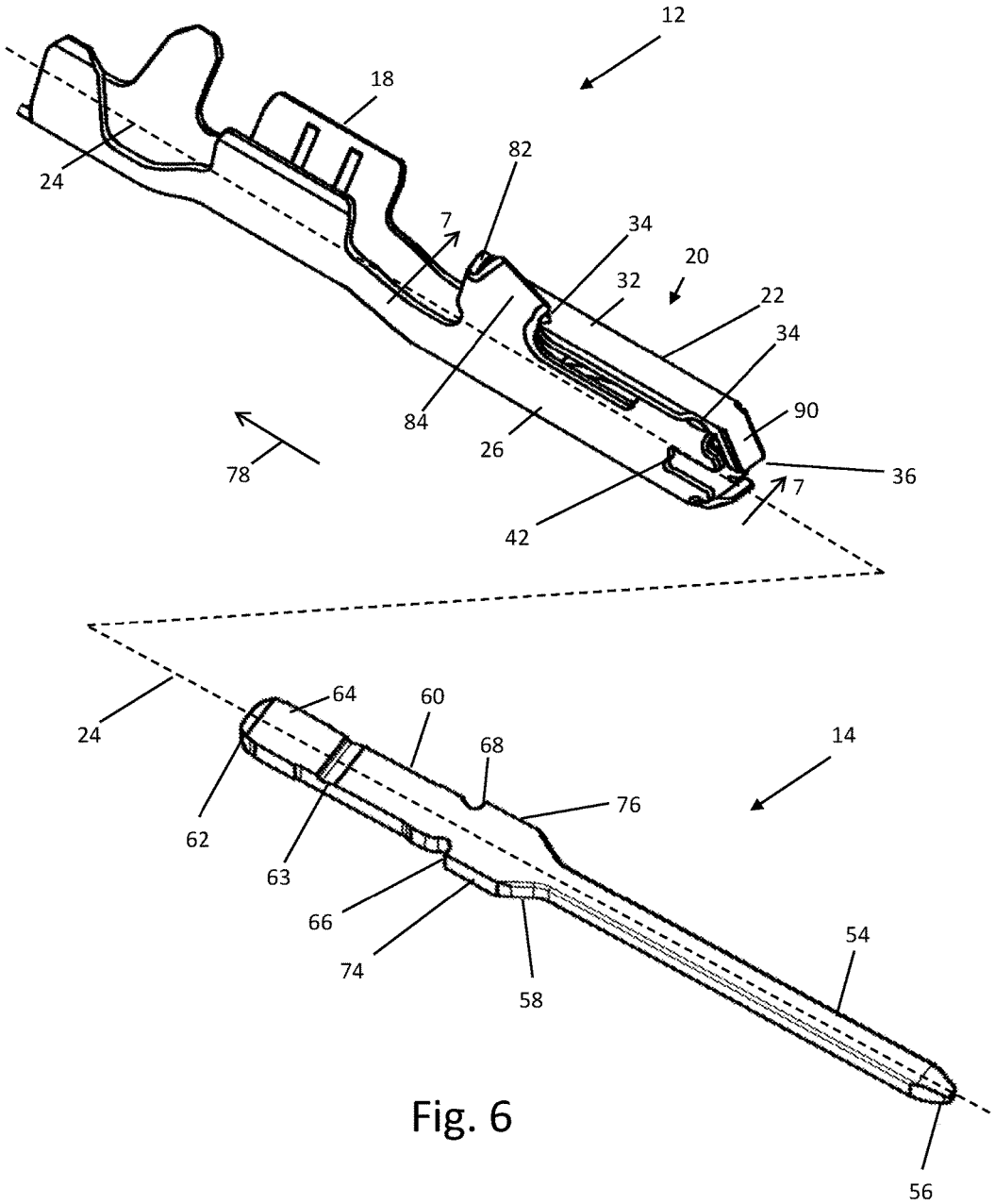
FIG. 6 is an exploded perspective view of the attachment piece and the contact piece show prior to assembly into the first embodiment of the two-piece male electric terminal.

Referring now to FIG. 6, a perspective view of the attachment piece 12 and the contact piece 14 are shown, prior to assembly to form the first embodiment of the two-piece male electric terminal 10. As shown in FIG. 6, the stamped blank 16 has been folded to form the attachment piece 12. The illustrated attachment piece 12 includes a crimping portion 18 that is adapted to be connected to a wire (not shown) by crimping in a manner that is well known in the art. It should be appreciated that the particular size of the attachment piece 12 may vary from that illustrated and may be selected based on the amount of current the two-piece male electric terminal 10 is designed to conduct, as well as the size of the wire the crimping portion 18 is adapted to be connected to. The attachment piece 12 also includes an attachment fastener portion, indicated generally at 20, that connects the attachment piece 12 to the contact piece 14, as will be described below. The attachment fastener portion 20 includes a box structure 22 that is positioned around and extends along a terminal axis 24. The box structure 22 includes two side walls 26 and 28 that are located on opposed sides of the terminal axis 24, and a lower wall 30 and an upper wall 32 that are also located on opposed sides of the terminal axis 24. The box structure 22 is folded into the illustrated shape and may, for example, be held together by one or more welds 34. The illustrated welds 34 are laser welds, but the welds 34 may be any kind of retainer.

The box structure 22 defines an insertion opening 36 that is located around the terminal axis 24. The insertion opening 36 communicates with and allows access to an interior space 40 defined within the box structure 22. The insertion opening 36 extends along the side walls 26 and 28 to respective box stops 42 and 44. The box stops 42 and 44 are leading edges of the side walls 26 and 28, and the purpose of the box stops 42 and 44 will be described below.

Figure 7:
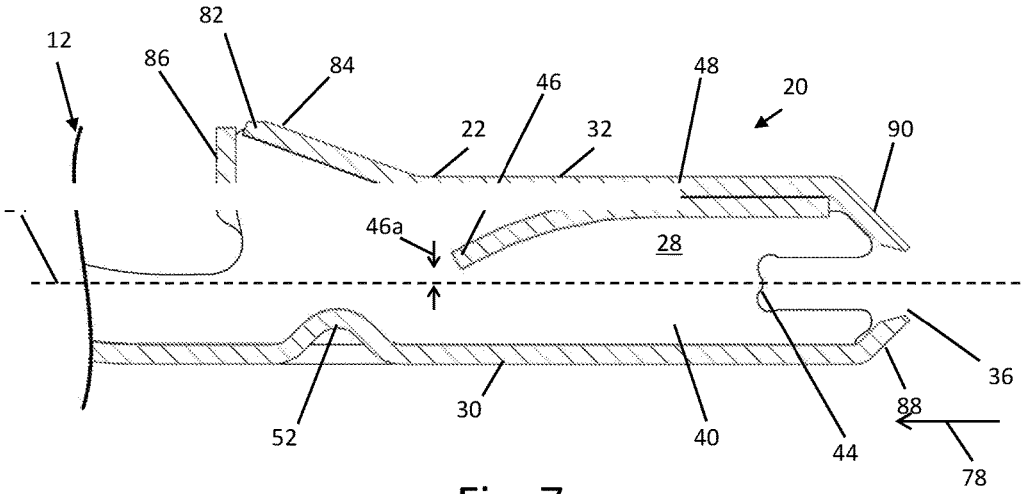
FIG. 7 is a cross-sectional view of a portion of the attachment piece taken along line 7-7 of FIG. 6.

As best shown in FIGS. 7 and 8, the attachment piece 12 includes a resilient first contact locator 46 that extends into the interior space 40. The illustrated first contact locator 46 is a wing that projects from a contact locator base 48 toward the terminal axis 24. The inner end of the illustrated first contact locator 46 terminates at an initial locator distance 46*a* (see FIG. 7) from the terminal axis 24. The illustrated contact locator base 48 is located adjacent to the upper wall 32. However, the first contact locater 46 may extend from any desired portion of the attachment piece 12 including, for example, the upper wall 32. As best shown in FIG. 3, the upper wall 32 is connected to the side wall 28, while the contact locator base 48 is connected to the opposed side wall 26. However, the contact locator base 48 may be in any other desired location. As also shown in FIG. 3, the stamped blank 16 includes two cuts 50 in the lower wall 30 that extend parallel to the terminal axis 24. Referring back to FIGS. 7 and 8, the material between the cuts 50 is pressed to form a second contact locator 52 that extends into the interior space 40. The purpose of the first contact locator 46 and the second contact locator 52 will be described below.

Referring back to FIG. 6, the contact piece 14 includes a lance 54 that extends along the terminal axis 24 from a contact end 56 to a mid-point 58, and a contact fastener portion 60 that extends along the terminal axis 24 from the mid-point 58 to an insertion end 62. However, the lance 54 and the contact fastener portion 60 may have different relative orientations, if desired. The contact fastener portion 60 includes a notch 63 located on an upper surface 64. The contact fastener portion 60 also includes a pair of contact stops 66 and 68 located on opposed extensions 72 and 74 of the contact fastener portion 60. The illustrated contact stops 66 and 68 are provided on leading edges of the opposed extensions 72 and 74, although such is not required. The purpose of the contact stops 66 and 68 will be described below.

To assemble the two-piece male electric terminal 10, the attachment piece 12 and the contact piece 14 are aligned along the terminal axis 24, and the insertion end 62 of the contact piece 14 is moved in an assembly direction 78 through the insertion opening 36 of the contact piece 14 and into the interior space 40. As best shown in FIG. 8, the insertion end 62 of the contact piece 14 will initially engage the first contact locator 46 and elastically deflect the resilient first contact locator 46 away from the terminal axis 24.

As the contact piece 14 is moved farther in the assembly direction 78, the first contact locator 46 will be biased against and engage the upper surface 64 of the contact fastener portion 60. As the contact piece 14 is moved farther in the assembly direction 78, it will eventually engage the second contact locator 52. The force applied on the contact piece 14 by the first contact locator 46 will bias the contact piece 14 against the second contact locator 52.

The contact piece 14 is continued to be moved farther in the assembly direction 78 until the first contact locator 46 rebounds into the notch 63 on the upper surface 64 of the contact fastener portion 60. At this point, the first contact locator 46 engages the notch 63 to provide greater resistance to movement in the assembly direction 78, as well as in a direction opposite to the assembly direction 78. This will provide tactile feedback to a person assembling the two-piece male electric terminal 10 that the contact piece 14 is in an assembled position relative to the attachment piece 12. The deflection of the first contact locator 46 deflecting into the notch 63 will also serve to temporarily retain the contact piece 14 in the assembled position relative to the attachment piece 12.

When the contact piece 14 is in the assembled position relative to the attachment piece 12, the first contact locator 46 is moved from the initial locator distance 46*a* to an assembled locator distance 46*b* (see FIG. 8) from the terminal axis 24. In the illustrated embodiment, the initial locator distance 46*a* is less than the assembled locator distance 46*b*. Therefore, the first contact locator 46 is pre-stressed when the contact piece 14 is in the assembled position relative to the attachment piece 12. Thus, prior to the assembly of the contact piece 14 to the attachment piece 12, the resilient contact locator 46 is in a rest position. During and after assembly of the contact piece 14 to the attachment piece 12, the contact piece 14 applies a force on the first contact locator 46 that deflects it from the rest position. When the contact piece 14 is placed in the assembled position relative to the attachment piece 12 (as shown in FIG. 8), the resilient contact locator 46 is moved from the rest position to a pre-stressed position. As a result, the first contact locator 46 applies an opposite force against the contact piece 14 that biases the contact piece 14 against the second contact locator 52.

As also shown in FIG. 7, when the contact piece 14 is in the assembled position relative to the attachment piece 12, the contact stop 66 on the contact piece 14 engages the box stop 42 on the attachment piece 12. It should be appreciated that although not visible in FIG. 7, the contact stop 68 similarly engages the box stop 44. The engagement of the contact stops 66 and 68 with the respective box stops 42 and 44 helps to prevent further movement of the contact piece 14 relative to the attachment piece 12 in the assembly direction 78.

Once the contact piece 14 is in the assembled position relative to the attachment piece 12, a weld 80 may be made between the attachment piece 12 and the contact piece 14 to retain the contact piece 14 in the assembled position relative to the attachment piece 12. The illustrated weld 80 is a laser weld applied between a portion of the upper wall 32 and a portion of upper surface 64 of the contact fastener portion 60, but the weld 80 may be any kind of retainer and may be applied on any desired location.

Although the illustrated embodiment of the two-piece male electric terminal 10 has been described with the first contact locator 46 extending from the upper wall 32 and the second contact locator 52 extending from the lower wall 30, it should be appreciated that the first contact locator 46 and the second contact locator 52 may extend from any two opposed walls of the box structure 22. Additionally, although the illustrated embodiment of the two-piece male electric terminal 10 has been described with the box structure 22 as part of the attachment piece 12, the box structure 22 may be part of the contact piece 14, if desired.

The two-piece male electric terminal 10 includes an optional polarizing projection 82 that extends from the attachment piece 12 and is adapted to limit the orientations at which the two-piece male electric terminal 10 may be inserted into a housing (not shown). The polarizing projection 82 includes a lead surface 84 that is at approximately a 30° angle relative to the terminal axis 24 and a lock surface 86 that is at approximately a 90° angle relative to the terminal axis 24. When the two-piece male electric terminal 10 is inserted into the housing, the lock surface 86 is engaged by a resilient lock on the housing in order to retain the two-piece male electric terminal 10 in the housing. As also best seen in FIG. 8, the two-piece male electric terminal 10 includes guide walls 88 and 90 that extend from the lower wall 30 and the upper wall 32 toward the terminal axis 24, almost into engagement with the contact piece 14. The illustrated guide walls 88 and 90 are extensions of the lower wall 30 and the upper wall 32, respectively, but may be any other desired component. The guide walls 88 and 90 assist in proper insertion of the two-piece male electric terminal 10 into the housing and help prevent damage to the housing or an associated seal.

Referring now to FIGS. 9 through 12, a second embodiment of a two-piece male electric terminal, indicated generally at 110, is illustrated. The alternative two-piece male electric terminal 110 includes many features that are similar to those of the previously-described two-piece male electric terminal 10, and such similar features are identified by the same reference number with a "100" prefix. Similar features will not be described in detail, but the description herein will describe features of the alternative two-piece male electric terminal 110 that are different from the two-piece male electric terminal 10.

The alternative two-piece male electric terminal 110 includes an attachment piece, indicated generally at 112 and a contact piece, indicated generally at 114. The alternative two-piece male electric terminal 110 is adapted to mate with a corresponding female connector (not shown) in a manner that is well known in the art. The illustrated alternative two-piece male electric terminal 110 is a 1.2 mm connector, and the contact piece 114 is wider than the contact piece 14. However, the contact piece 114 and the alternative two-piece male electric terminal 110 may be any desired sizes.

The illustrated attachment piece 112 includes a crimping portion 118 and an attachment fastener portion, indicated generally at 120, that connects the attachment piece 112 to the contact piece 114. The attachment fastener portion 120 includes a box structure 122 that is positioned around and extends along a terminal axis 124.

The box structure 122 includes two side walls 126 and 128 that are located on opposed sides of the terminal axis 124, and a lower wall 130 and an upper wall 132 that are located on opposed sides of the terminal axis 124. The box structure 122 may, as described above, be folded into the shape illustrated and held together by welds 134.

The box structure 122 defines an insertion opening 136 that is located around the terminal axis 124. The insertion opening 136 communicates with and allows access to an interior space 140 defined within the box structure 122. The insertion opening 136 extends along the side walls 126 and 128 to respective box stops 142 and 144. The box stops 142 and 144 are leading edges of the side walls 126 and 128.

The side wall 126 includes a contact locator 192 that extends from the side wall 126 toward the terminal axis 124. Similarly, the side wall 128 includes a contact locator 194 that extends from the side wall 128 toward the terminal axis 124. The contact locators 192 and 194 are located on opposed sides of the terminal axis 124. When the contact piece 114 is mated with the attachment piece 112, a contact fastener portion 160 of the contact piece 114 is located between and is engaged by both the contact locator 192 and the contact locator 194. This helps to properly position the contact piece 114 relative to the box structure 122 between the side walls 126 and 128. Additionally, the contact locator 192 and the contact locator 194 provide electrical communication between the attachment piece 112 and the contact piece 114.

The attachment piece 112 includes a first resilient contact locator 146' and a second resilient contact locator 146" located in the interior space 140. The first resilient contact locator 146' is a wing that projects from the lower wall 130 toward the terminal axis 124, and the second resilient contact locator 146" is a wing that projects from the upper wall 132 toward the terminal axis 124. The first resilient contact locator 146' and the second resilient contact locator 146" are located on opposed sides of the terminal axis 124.

Figure 10:
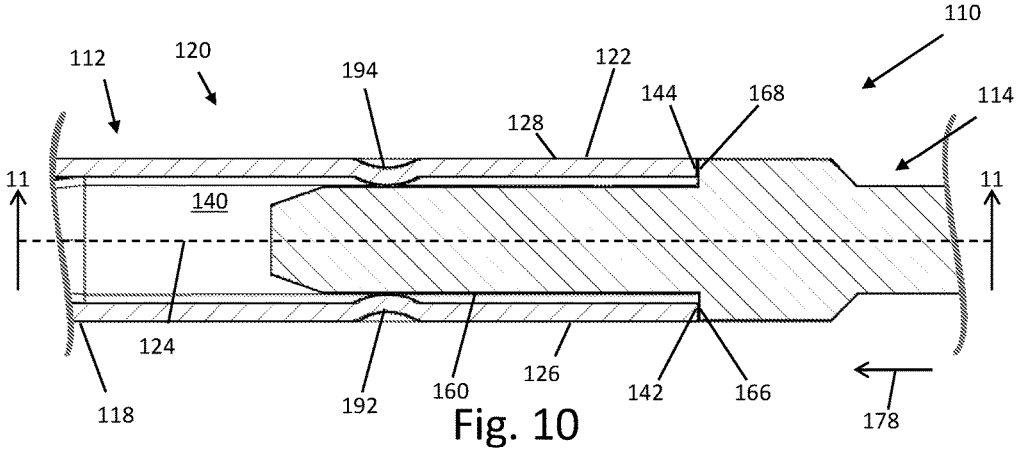
FIG. 10 is a cross-sectional view of the second embodiment of the two-piece male electric terminal taken along line 10-10 of FIG. 9.

The alternative two-piece male electric terminal 110 may be assembled similarly to the previously described two-piece male electric terminal 10. The contact piece 114 is moved relative to the attachment piece 112 along the terminal axis 124 and through the insertion opening 136 in an assembly direction 178. The contact fastener portion 160 of the contact piece 144 engages the contact locator 192 and the contact locator 194, which function to properly position the contact piece 114 relative to the box structure 122 between the side walls 126 and 128, as shown in FIG. 10. The contact piece 114 also engages the first resilient contact locator 146' and the second resilient contact locator 146", which function to properly position the contact piece 114 relative to the box structure 122 between the upper wall 132 and the lower wall 130, as shown in FIG. 11.

The contact piece 114 is moved in the assembly direction 178 until contact stops 166 and 168 provided on the contact piece 114 engage the respective box stops 142 and 144 provided on the attachment piece 112, as shown in FIG. 10. At this point, the contact piece 114 is positioned in an assembled positioned relative to the attachment piece 112. A weld 180 can then applied between the attachment piece 112 and the contact piece 114 to retain the contact piece 114 in the assembled position relative to the attachment piece 112.

Figure 11:
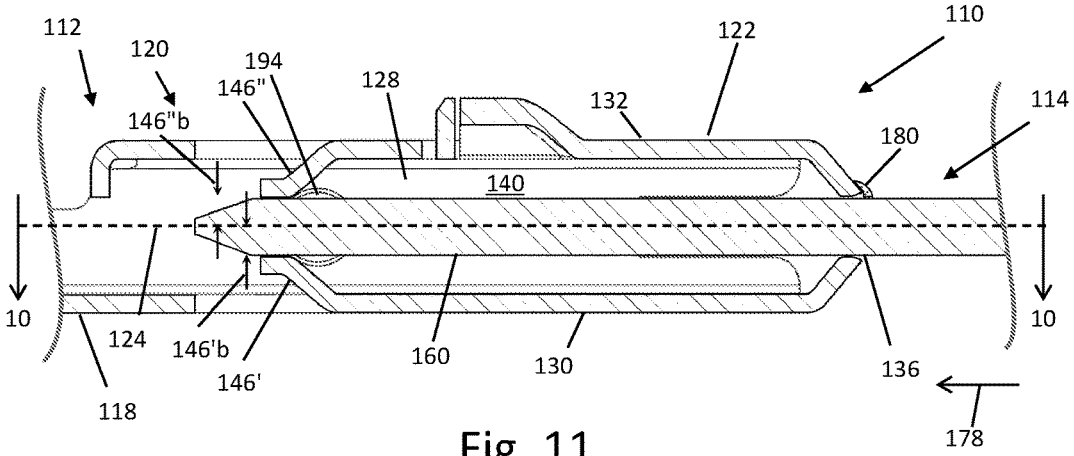
FIG. 11 is a cross-sectional view of the second embodiment of the two-piece male electric terminal taken along line 11-11 of FIG. 9.
Figure 12:
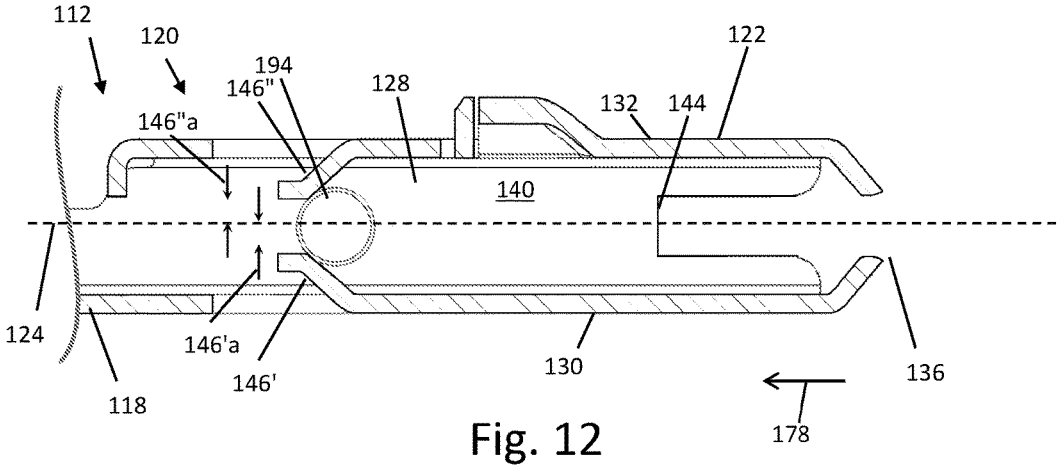
FIG. 12 is a cross-sectional view similar to FIG. 11 illustrating an attachment piece of the second embodiment of the two-piece male terminal before it is connected to a contact piece.

Referring to FIG. 12, a cross-sectional view similar to FIG. 11 is illustrated, showing the attachment piece 112 prior to insertion of the contact piece 114. As shown, the first resilient contact locator 146' is a first initial distance 146'*a* from the terminal axis 124, and the second resilient contact locator 146" is a second initial distance 146"*a* from the terminal axis 124. These initial distances 146'*a* and 146"*a* are respective rest positions of the first resilient contact locator 146' and the second resilient contact locator 146".

Referring back to FIG. 11, when the contact piece 114 is in the assembled position relative to the attachment piece 112, the first resilient contact locator 146' and the second resilient contact locator 146" are both deflected away from the terminal axis 124. The first resilient contact locator 146' is a first assembled distance 146'*b* from the terminal axis 124, and the second resilient contact locator 146" is a second assembled distance 146"*b* from the terminal axis 124. These assembled distances 146'*b* and 146"*b* are greater than the respective initial distances 146'*a* and 146"*a*. Therefore, the first resilient contact locator 146' and the second resilient contact locator 146" are pre-stressed when the contact piece 114 is in the assembled position relative to the attachment piece 112.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A two-piece male electric terminal comprising:

an attachment piece including an attachment fastener portion that extends along a terminal axis; and a contact piece including a lance and a contact fastener portion that extends along the terminal axis; wherein one of the attachment fastener portion and the contact fastener portion includes a box structure that is positioned around and extends along the terminal axis and defines an interior space, the box structure including (1) a first contact locator that extends into the interior space and (2) a second contact locator that extends into the interior space and is axially offset from the first contact locator, and the other of the attachment fastener portion and the contact fastener portion is located in the interior space, wherein each of the first and second contact locators resiliently engages the other of the attachment fastener portion and the contact fastener portion.

2. The two-piece male electric terminal of claim 1, further including a notch on the other of the attachment fastener portion and the contact fastener portion, wherein the first contact locator is located in the notch.

3. The two-piece male electric terminal of claim 1, further including a crimping portion that extends from the attachment portion and is adapted to be crimped to a wire.

4. The two-piece male electric terminal of claim 1, wherein the first contact locator and the second contact locator are located on opposed sides of the terminal axis.

5. The two-piece male electric terminal of claim 1, wherein the box structure includes two side walls that are located on opposed sides of the terminal axis, and a lower wall and an upper wall that are located on opposed sides of the terminal axis, and wherein the first contact locator projects from a contact locator base that is located adjacent to the upper wall.

6. The two-piece male electric terminal of claim 5, further including contact locators that extend from each of the side walls and engage the other of the attachment fastener portion and the contact fastener portion.

7. The two-piece male electric terminal of claim 4, further including a notch on the other of the attachment fastener portion and the contact fastener portion, wherein the first contact locator is located in and engages the notch.

8. A two-piece male electric terminal comprising:

an attachment piece including an attachment fastener portion that extends along a terminal axis, the attachment fastener portion including a box structure that is positioned around and extends along the terminal axis and defines an interior space, the box structure including (1) a first contact locator that extends into the interior space and (2) a second contact locator that extends into the interior space and is axially offset from the first contact locator;

a contact piece including a lance and a contact fastener portion that extends along the terminal axis and is located in the interior space, wherein each of the first and second contact locators resiliently engages the contact fastener portion, wherein the first contact locator and the second contact locator are located on opposed sides of the terminal axis; and a retainer that retains the contact piece in an assembled position relative to the attachment piece.

9. A method of assembling a two-piece male electric terminal, the method comprising the steps of:

moving an attachment piece relative to a contact piece along a terminal axis in an assembly direction so that an insertion end on one of the attachment piece and the contact piece is moved into an interior space of a box structure on the other of the attachment piece and the contact piece;

deflecting a resilient contact locator away from the terminal axis by a force applied by the movement of the one of the attachment piece and the contact piece;

continuing to move the attachment piece relative to the contact piece along the terminal axis in the assembly direction to an assembled position; and welding the attachment piece to the contact piece to retain the attachment piece and the contact piece in the assembled position.

10. The method of assembling a two-piece male electric terminal of claim 9, wherein the step of continuing to move the attachment piece relative to the contact piece further includes causing the contact locator to deflect toward the terminal axis into a notch on the one of the attachment piece and the contact piece when the attachment piece and the contact piece are in the assembled position.

11. The method of assembling a two-piece male electric terminal of claim 9, wherein the step of deflecting a resilient contact locator includes the steps of (1) initially deflecting a first contact locator that extends into the interior space and (2) subsequently deflecting a second contact locator that extends into the interior space and is axially offset from the first contact locator.

12. The method of assembling a two-piece male electric terminal of claim 9, wherein the step of deflecting a resilient contact locator includes the steps of (1) initially deflecting a first contact locator on a first side of the terminal axis that extends into the interior space and (2) subsequently deflecting a second contact locator on a second side of the terminal axis opposite to the first side and that extends into the interior space and is axially offset from the first contact locator.

* * * * *